US009240138B2

(12) United States Patent
Seo

(10) Patent No.: US 9,240,138 B2
(45) Date of Patent: Jan. 19, 2016

(54) ORGANIC LIGHT EMITTING DIODE DISPLAY DEVICE AND METHOD FOR DRIVING THE SAME

(71) Applicant: LG DISPLAY CO., LTD., Seoul (KR)

(72) Inventor: Jung-Min Seo, Anyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 343 days.

(21) Appl. No.: 13/672,200

(22) Filed: Nov. 8, 2012

(65) Prior Publication Data

US 2013/0113775 A1 May 9, 2013

(30) Foreign Application Priority Data

Nov. 9, 2011 (KR) ..... 10-2011-0116659

(51) Int. Cl.
*G09G 3/32* (2006.01)

(52) U.S. Cl.
CPC ..... *G09G 3/3208* (2013.01); *G09G 2330/021* (2013.01); *G09G 2330/028* (2013.01)

(58) Field of Classification Search
CPC ..... G09G 2330/00–2330/022
See application file for complete search history.

(56) References Cited

U.S. PATENT DOCUMENTS

| | | | | |
|---|---|---|---|---|
| 2008/0238397 | A1 | 10/2008 | Chen et al. | |
| 2008/0246702 | A1* | 10/2008 | Lee et al. | 345/77 |
| 2009/0109147 | A1* | 4/2009 | Park et al. | 345/76 |
| 2009/0116153 | A1 | 5/2009 | Lin et al. | |
| 2010/0220088 | A1 | 9/2010 | Kim | |
| 2011/0050669 | A1 | 3/2011 | Ahn | |
| 2011/0261043 | A1* | 10/2011 | Hayakawa et al. | 345/211 |

FOREIGN PATENT DOCUMENTS

| | | | |
|---|---|---|---|
| CN | 102044214 | A | 5/2011 |
| EP | 1 895 494 | A1 | 3/2008 |
| KR | 10-2011-0038915 | A | 4/2011 |

* cited by examiner

*Primary Examiner* — Sanghyuk Park
(74) *Attorney, Agent, or Firm* — Birch, Stewart, Kolasch & Birch, LLP

(57) ABSTRACT

An organic light emitting diode (OLED) display device and a method are discussed. The OLED display device includes a display panel, a power supply unit for supplying drive voltages having different levels respectively corresponding to a user image display mode and an idle mode to power lines of a display panel in accordance with the user image display mode and the idle mode, respectively, a timing controller for controlling the power supply unit, to thereby control image display operations in accordance with the user image display mode and the idle mode, respectively, and a drive voltage generating unit for varying a level of a feedback voltage thereof in accordance with a predetermined feedback reference voltage select signal so that the same period of time is taken to generate the drive voltages upon a mode change to the user image display mode and a mode change to the idle mode, respectively.

9 Claims, 8 Drawing Sheets

ORGANIC LIGHT EMITTING DIODE DISPLAY DEVICE AND METHOD FOR DRIVING THE SAME

This application claims priority to and the benefit of Korean Patent Application No. 10-2011-0116659, filed on Nov. 9, 2011, which is hereby incorporated by reference as if fully set forth herein.

BACKGROUND OF THE INVENTION

1. Field of the Invention

Embodiments of the invention relate to an organic light emitting diode (OLED) display device and a method for driving the same, which avoid display failure caused by flicker or glare occurring when an operation mode of the OLED display device is changed to an idle mode under the condition that the OLED display device is applied to a mobile communication device such as a smartphone or a tablet computer, thereby being capable of achieving an enhancement in reliability.

2. Discussion of the Related Art

As flat panel display devices that have recently been highlighted, there are a liquid crystal display (LCD) device, a field emission display (FED) device, a plasma display panel (PDP) device, an organic light emitting diode (OLED) display device, etc. Among such flat panel display devices, the OLED display device is a self-luminous device in which an organic light emitting layer emits light through re-combination of electrons and holes. Since the OLED display device exhibits high brightness, and employs a low drive voltage while having an ultra-slim structure, it is expected to be a next-generation display device.

Such an OLED display device includes a plurality of unit pixels, each of which includes an OLED constituted by an anode, a cathode, and an organic light emitting layer interposed between the anode and the cathode, and a pixel circuit for independently driving the OLED.

The OLED display device is usefully applied to mobile communication devices such as smartphones or tablet computers because OLED display device exhibits high brightness, and employs a low drive voltage while having an ultra-slim structure.

Recently, for transmission of image signals or control signals, a command communication protocol such as mobile industry processor interface (MIPI) interface protocol has been applied to the mobile communication devices. In some instances, it has also been required to employ a command communication protocol for an idle mode (for example, a partial idle mode) requiring low-consumption of electric power. In other words, in an idle mode, in which only basic information such as information as to current time or weather is displayed to allow the user to identify the displayed information, various matters should be taken into consideration, differently than an image display mode, in which an image, etc., are displayed at a user's request.

For example, in the instance of an LCD device, it may be possible to simply implement an idle mode requiring low consumption of electric power, simply by turning a backlight off. On the other hand, in the instance of an OLED display device, a driving system for driving the OLED display device at a lowered drive voltage or at a lowered drive frequency was employed because the OLED display device is a self-luminous display device. However, when the OLED display device is driven at a lowered drive frequency, the blank period, in which no image is displayed, is lengthened because driving control signals are frequency-modulated in proportion to the drive frequency. As a result, there is a problem in that the blank period is recognized by the naked eye. When the OLED display device is driven using a variable drive voltage, there may be a problem of irregular mode change driving timing because capacities of a capacitor and resistors employed in the display device are fixed.

In other words, each of the capacitor and resistors of a feedback circuit employed for stabilization of a drive current and a drive voltage from a power IC is set to have an optimal capacity in order to avoid abnormal current variation or the like. However, when variation in current amount and voltage level occur during mode change to an idle mode or an image display mode, the drive current and drive voltage from the power IC exhibit different driving start timings for respective modes in accordance with respective fixed capacities of the capacitor and resistors. In this instance, display failure caused by flicker or glare may occur. Due to such a display failure, there may be a degradation in reliability or other problems.

SUMMARY OF THE INVENTION

Accordingly, the invention is directed to an organic light emitting diode display device and a method for driving the same that substantially obviate one or more problems due to limitations and disadvantages of the related art.

An object of the invention is to provide an organic light emitting diode (OLED) display device and a method for driving the same, which avoid display failure caused by flicker or glare occurring when the operation mode of the OLED display device is changed to an idle mode under the condition that the OLED display device is applied to a mobile communication device such as a smartphone or a tablet computer, thereby being capable of achieving an enhancement in reliability.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an organic light emitting diode display device includes a display panel including a plurality of pixel regions, a power supply unit for supplying drive voltages having different levels respectively corresponding to a user image display mode and an idle mode to power lines of the display panel in accordance with the user image display mode and the idle mode, respectively, a timing controller for controlling the power supply unit, to thereby control image display operations in accordance with the user image display mode and the idle mode, respectively, and a drive voltage generating unit for varying a level of a feedback voltage thereof in accordance with a predetermined feedback reference voltage select signal supplied from outside or from the timing controller so that the same period of time is taken to generate the drive voltages upon a mode change to the user image display mode and a mode change to the idle mode, respectively, and then to output the generated drive voltages to the power supply unit.

The drive voltage generating unit may include a power IC for varying the level of the feedback voltage thereof such that the level of the feedback voltage corresponds to the feedback reference voltage select signal, thereby adjusting a feedback voltage charging period in accordance with the varied level of the feedback voltage, to generate the drive voltages having different levels respectively corresponding to the user image display mode and the idle mode within the same period of time, and a feedback circuit arranged between a drive voltage output terminal of the power IC and a feedback terminal of the power IC, to charge feedback voltages of different levels respectively corresponding to the user image display mode and the idle mode in accordance with feedback voltage charging periods respectively adjusted in accordance with the user image display mode and the idle mode.

The power IC may include a multiplexer for receiving a plurality of voltages having different levels, and selecting and outputting one of the different voltages in accordance with the feedback reference voltage select signal, to set the level of the feedback voltage and to output the set feedback voltage, an operational amplifier for receiving the set feedback voltage and a start timing control signal, which has a gradually-increasing level, at inverting and non-inverting terminals thereof, respectively, to output a feedback voltage charging control signal during a period in which the start timing control signal has a lower level than the set feedback voltage, and a feedback switching element for charging the feedback circuit with a selected one of the feedback voltages for a selected one of the feedback voltage charging periods in accordance with the feedback voltage charging control signal.

The operational amplifier may output a feedback voltage charging control signal to turn on the feedback switching element, during a period in which the gradually-increasing level of the start timing control signal is lower than or equal to the level of the set feedback voltage. The operational amplifier may output the feedback voltage charging control signal, to turn off the feedback switching element, during a period in which the gradually-increasing level of the start timing control signal is higher than the level of the set feedback voltage.

The feedback reference control select signal may set the level of the feedback voltage of the multiplexer such that a soft start time of the user image display mode and a soft start time of the idle mode are adjusted to be within 2.0 ms upon mode change to the user image display mode and mode change to the idle mode, respectively.

In another aspect of the invention, a method for driving an organic light emitting diode display device includes supplying drive voltages having different levels respectively corresponding to a user image display mode and an idle mode to power lines of a display panel including a plurality of pixel regions, using a power supply unit, in accordance with the user image display mode and the idle mode, respectively, controlling the power supply unit, to thereby control image display operations in accordance with the user image display mode and the idle mode, respectively, and varying a level of a feedback voltage in accordance with a predetermined feedback reference voltage select signal supplied from outside or from the timing controller so that the same period of time is taken to generate the drive voltages upon a mode change to the user image display mode and a mode change to the idle mode, respectively, and outputting the generated drive voltages to the power supply unit.

The generating of drive voltages having different levels respectively corresponding to the user image display mode and the idle mode may include varying the level of the feedback voltage such that the level of the feedback voltage corresponds to the feedback reference voltage select signal by a power IC, thereby adjusting a feedback voltage charging period in accordance with the varied level of the feedback voltage, to generate drive voltages having different levels respectively corresponding to the user image display mode and the idle mode within the same period of time, and charging feedback voltages of different levels respectively corresponding to the user image display mode and the idle mode in accordance with feedback voltage charging periods respectively adjusted in accordance with the user image display mode and the idle mode, by a feedback circuit arranged between a drive voltage output terminal of the power IC and a feedback terminal of the power IC.

The generating of drive voltages having different levels respectively corresponding to the user image display mode and the idle mode may include receiving a plurality of voltages having different levels by a multiplexer, and selecting and outputting one of the different voltages by the multiplexer in accordance with the feedback reference voltage select signal, to set the level of the feedback voltage and to output the set feedback voltage, receiving the set feedback voltage and a start timing control signal, which has a gradually-increasing level, at inverting and non-inverting terminals of an operational amplifier, respectively, to output a feedback voltage charging control signal during a period in which the start timing control signal has a lower level than the set feedback voltage, and charging the feedback circuit with a selected one of the feedback voltages for a selected one of the feedback voltage charging periods in accordance with the feedback voltage charging control signal by a feedback switching element.

The outputting of a feedback voltage charging control signal may include outputting a feedback voltage charging control signal to turn on the feedback switching element, during a period in which the gradually-increasing level of the start timing control signal is lower than or equal to the level of the set feedback voltage, and outputting the feedback voltage charging control signal, to turn off the feedback switching element, during a period in which the gradually-increasing level of the start timing control signal is higher than the level of the set feedback voltage.

The feedback reference control select signal may set the level of the feedback voltage of the multiplexer such that a soft start time of the user image display mode and a soft start time of the idle mode are adjusted to be within 2.0 ms upon mode change to the user image display mode and mode change to the idle mode, respectively.

It is to be understood that both the foregoing general description and the following detailed description of the invention are by example and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle of the invention. In the drawings.

DETAILED DESCRIPTION OF THE INVENTION

Reference will now be made in detail to the example embodiments of the invention associated with an organic light emitting diode display device and a method for driving the same, examples of which are illustrated in the accompanying drawings.

Figure 1:
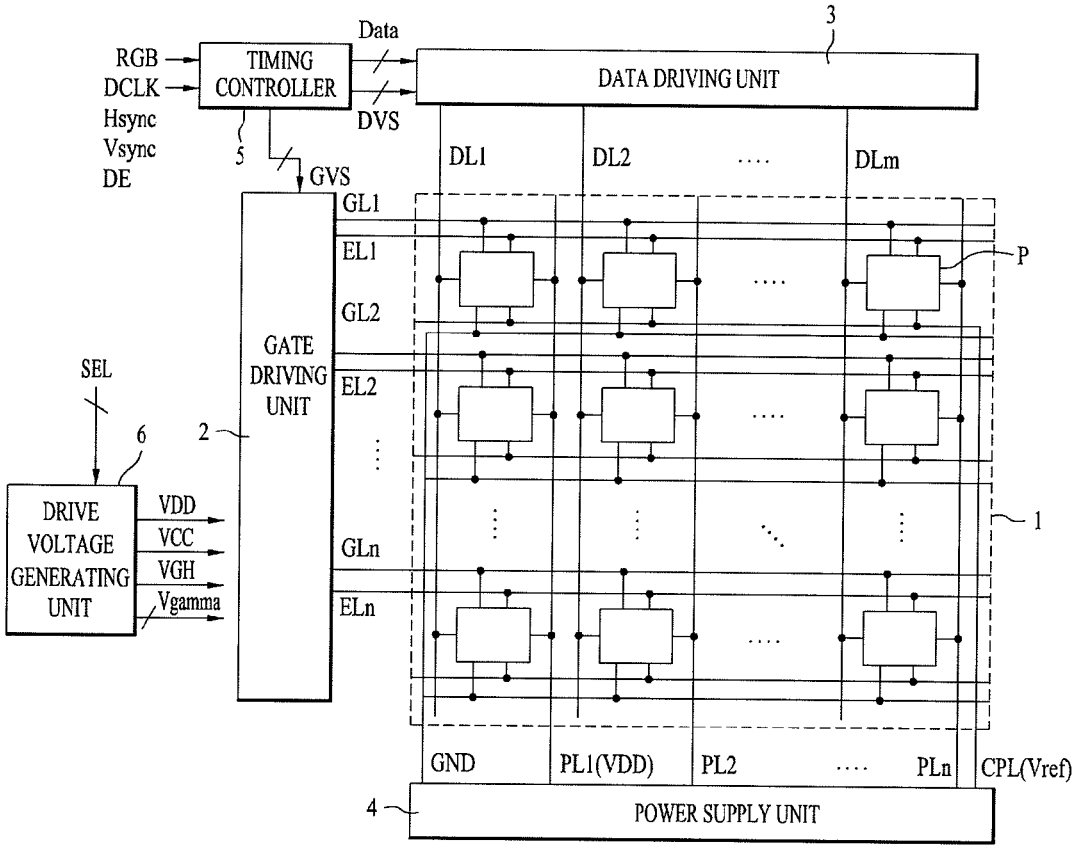
FIG. 1 is a block diagram illustrating an organic light emitting diode (OLED) display device according to an example embodiment of the invention.
Figure 2:
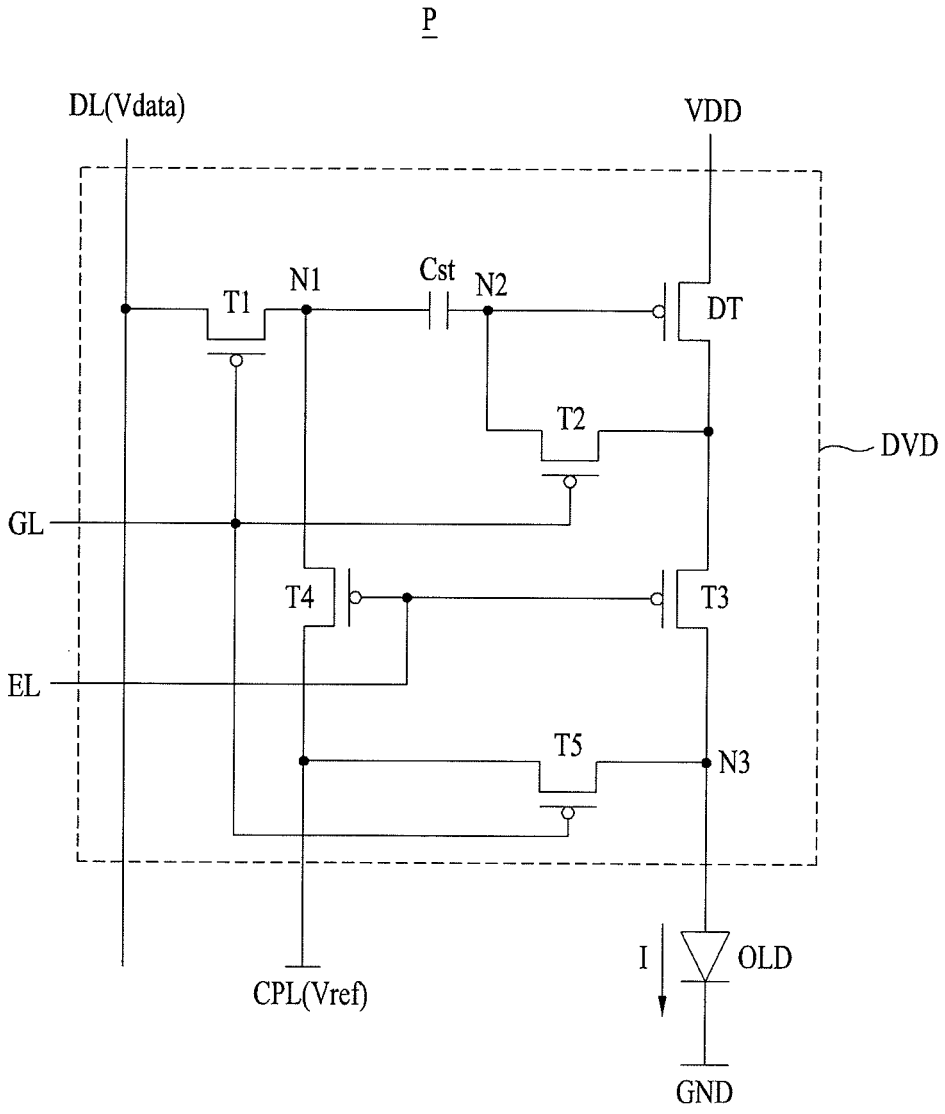
FIG. 2 is an equivalent circuit diagram of one sub-pixel in a display panel shown in FIG. 1.

FIG. 1 is a block diagram illustrating an organic light emitting diode (OLED) display device according to an example embodiment of the invention. FIG. 2 is an equivalent circuit diagram of one sub-pixel in a display panel shown in FIG. 1.

The OLED display device shown in FIG. 1 includes a display panel 1 including a plurality of pixel regions, a gate driving unit 2 for driving gate lines GL1 to GLn and light emission control lines EL1 to ELn of the display panel 1, a data driving unit 3 for driving data lines DL1 to DLm of the display panel 1, and a power supply unit 4 for supplying a drive voltage VDD to power lines PL1 to PLm of the display panel 1 and a compensation voltage Vref to a compensation power line CPL. The OLED display device also includes a timing controller 5 for controlling not only the power supply unit 4, but also the gate and data driving units 2 and 3, to control an image display operation in accordance with a user image display mode or an idle mode, and a drive voltage generating unit 6 for varying the level of a feedback voltage thereof in accordance with a predetermined feedback reference voltage select signal SEL supplied from outside or from the timing controller 5, to output drive voltages VDD having different levels respectively corresponding to the user image display mode and idle mode within the same period of time upon a mode change to the user image display mode and a mode change to the idle mode, respectively. Thus, it takes the same period of time to output drive voltages VDD having different levels respectively corresponding to the user image display mode and idle mode within upon the mode change to the user image display mode and the mode change to the idle mode, respectively.

The pixel regions of the display panel 1 are arranged in the form of a matrix array, and a plurality of sub-pixels P is arranged in each pixel region, to display an image. Each sub-pixel P includes a light emitting cell OLD, and a cell driver DVD for independently driving the light emitting cell OLD. In detail, the sub-pixel P, which is illustrated in FIG. 2, includes a cell driver DVD connected to a gate line GL, a data line DL, a compensation power line CPL, a light emission control line EL and a power line PL, and a light emitting cell OLD connected between the cell driver DVD and a second voltage signal GND, to be equivalently represented by a diode.

The cell driver DVD may include first to fifth switching elements T1 to T5, a driving switching element DT, and a storage capacitor Cst. In this instance, each of the first to fifth switching elements T1 to T5 and driving switching element DT may be constituted by an NMOS transistor, a PMOS transistor or the like. The following description will be given in conjunction with the instance in which each of the first to fifth switching elements T1 to T5 and driving switching element DT is constituted by a PMOS transistor.

The first switching element T1 supplies a data signal Vdata from the data line DL to a first node N1 in response to a low-logic gate voltage from the gate line GL, to charge the storage capacitor Cst.

The second switching element T2 connects gate and drain electrodes of the driving switching element DT in response to the low-logic gate voltage from the gate line GL, to connect the driving switching element DT in the form of a diode.

The third switching element T3 connects the drain electrode of the driving switching element DT to an anode electrode of the light emitting cell OLD in response to a low-logic light emission control voltage from the light emission control line EL. That is, the third switching element T3 supplies data current output from the driving switching element DT to the light emitting cell OLD in accordance with the low-logic light emission control voltage.

The fourth switching element T4 applies the compensation voltage Vref supplied via the compensation power line CPL to the first node N1 in response to the low-logic light emission control voltage from the light emission control line EL.

The fifth switching element T5 applies the compensation voltage Vref supplied via the compensation power line CPL to a third node N3, to which the light emitting cell OLD is connected, in response to the low-logic gate voltage from the gate line GL. In this instance, the fifth switching element T5 is an element for stabilizing the cell driver DVD and, as such, there is no influence on the driving operation of the cell driver DVD even when the fifth switching element T5 is dispensed with.

The driving switching element DT controls the amount of current flowing through the light emitting cell OLD in response to a voltage on a second node N2.

The storage capacitor Cst is arranged between the first node N1 and the second node N2, to store a difference voltage between the first and second nodes N1 and N2. When the first switching element T2 is turned off, the storage capacitor Cst sustains an ON state of the driving switching element DT for a predetermined period, for example, one frame period, using the stored voltage.

The anode electrode of the light emitting cell OLD is connected to the cell driver DVD. The light emitting cell OLD also includes a cathode electrode connected to the second voltage signal GND, which is a low-level voltage, and an organic layer formed between the anode electrode and the cathode electrode. The light emitting cell OLD, which has the above-described configuration, emits light, using current supplied from the driving switching element DT via the third switching element T3 of the cell driver DVD.

The gate driving unit 2 of FIG. 1 sequentially generates gate-on signals (for example, low-logic gate voltages) in response to gate control signals GVS from the timing controller 5, for example, a gate start pulse GSP and a gate shift clock GSC, while controlling the pulse width of each gate-on signal in accordance with a gate output enable signal GOE. The gate-on signals are sequentially supplied to respective gate lines GL1 to GLn. In this instance, in a period in which no gate-on signal is supplied, a gate-off signal (for example, a high-logic gate voltage) is supplied to each of the gate lines GL1 to GLn. Accordingly, the gate driving unit 2 drives the first and second switching devices T1 and T2 of respective sub-pixels connected to respective gate lines GL1 to GLn by the unit of one gate line GL. The gate driving unit 2 may supply a high-logic gate voltage during a data input period in one horizontal period while supplying a low-logic gate voltage during a scan period in one horizontal period. In this instance, no data voltage is supplied to the light emitting cells OLD during the data input period. The data voltage is supplied to the light emitting cells OLD during the scan period in one horizontal period.

The gate driving unit 2 also sequentially generates high or low-logic light emission control voltages, and supplies the generated voltages to respective light emitting control lines EL1 to ELn. In this instance, each of the sequentially-output light emitting control voltages controls a period in which current flows to the light emitting cell OLD of the corresponding sub-pixel, that is, a period in which an image is displayed, and a period in which the compensation voltage Vref is supplied to the fourth switching element T4 of the corresponding sub-pixel. In other words, the gate driving unit 2 controls an image display period and a blanking period in which a black image is displayed.

The data driving unit 3 converts digital image data Data received from the timing controller 5 into an analog voltage, namely, an analog data voltage, using a source start pulse SSP and a source shift clock SSC, which are include in data control signals DVS from the timing controller 5. In this instance, the data driving unit 3 performs conversion of the digital image data Data into the analog data voltage, using a gamma voltage set having finely-divided gamma voltages respectively corresponding to gray levels of digital image data. The data driving unit 3 also supplies a data voltage to each of the data lines DL1 DLm in response to a source output enable signal SOE. In detail, the data driving unit 3 latches digital image data Data received in accordance with a source shift clock SSC, and supplies data voltages corresponding to one horizontal line to respective data lines DL1 to DLm at intervals of one horizontal period, that is, in every horizontal period in which a gate-on signal is supplied to one of the gate lines GL1 to GLn, in response to the source output enable signal SOE.

The power supply unit 4 supplies a power signal VCC to the display panel 1. The power supply unit 4 also converts the level of the compensation voltage Vref supplied to the compensation power line CPL into a predetermined positive voltage level or a ground voltage level, and outputs the level-converted voltage. In addition, the power supply unit 4 supplies, to the power lines PL1 to PLm, a drive voltage having a level determined in accordance with a user image display mode or an idle mode under control of the timing controller 5. Drive voltages of different levels are supplied in the user image display mode and idle mode, respectively. In this instance, the level of the drive voltage VDD supplied to the power lines PL1 to PLm in the user image display mode is higher than that of the drive voltage VDD supplied to the power lines PL1 to PLm in the idle mode. That is, in the idle mode, an idle mode image is displayed using a lower-level drive voltage VDD, to reduce power consumption.

The timing controller 5 aligns RGB data RGB received from outside, to match the size and resolution of the display panel 1, and supplies the aligned digital image data, namely, digital image data Data, to the data driving unit 3. The timing controller 5 also generates the gate and data control signals GVS and DVS, using synchronizing signals received from outside, for example, a dot clock DCLK, a data enable signal DE, a horizontal synchronizing signal Hsync and a vertical synchronizing signal Vsync, and supplies the gate and data control signals GVS and DVS to the gate driving unit 2 and the data driving unit 3, respectively. In addition, the timing controller 5 controls the drive voltage generating unit 6 and power supply unit 4 such that drive voltages VDD of different levels are supplied to the power lines PL1 to PLm in accordance with the user image display mode and the idle mode, respectively. That is, the timing controller 5 controls the drive voltage generating unit 6 such that the level of the drive voltage VDD in the user image display mode is higher than the level of the drive voltage VDD in the idle mode, and also controls the power supply unit 4 to supply, to the power lines PL1 to PLm, respective mode-corresponding drive voltages VDD in accordance with the user image display mode and the idle mode.

The drive voltage generating unit 6 varies the level of a feedback voltage thereof in accordance with a predetermined feedback reference voltage select signal SEL supplied from outside or from the timing controller 5. In accordance with the variation in the level of the feedback reference voltage, the drive voltage generating unit 6 then outputs drive voltages VDD having different levels respectively corresponding to the user image display mode and idle mode within the same period of time upon mode change to the user image display mode and mode change to the idle mode, respectively. In detail, when the level of the drive voltage VDD output in the user image display mode is higher than the level of the drive voltage VDD output in the idle mode, the period, in which the variation in the level of the drive voltage VDD is carried out, is varied in accordance with mode change due to the voltage difference between the user image display mode and the idle mode. For example, although variation in the level of the drive voltage VDD from the level in the idle mode to the level in the user image display mode may be rapidly carried out, variation in the level of the drive voltage VDD from the level in the user image display mode to the level in the idle mode may be carried out for a prolonged period of time. This is because the capacities of resistors and capacitors in a feedback circuit included in the drive voltage generating unit 6 are fixed to predetermined values, respectively. Generally, it is desirable that the capacitors have large capacities, for stable current output in the image display mode. However, the time taken for variation in the level of the drive voltage VDD to the level in the idle mode is lengthened due to the large capacity of each capacitor. To this end, the drive voltage generating unit 6 varies the level of the feedback voltage thereof to an optimal level in accordance with the user image display mode or the idle mode, to generate drive voltages VDD having different levels respectively corresponding to the user image display mode and idle mode within the same period of time. Although the drive voltage generating unit 6 and power supply unit 4 are illustrated as being separate from each other, a configuration, in which the drive voltage generating unit 6 is internally provided at the power supply unit 4, may be implemented.

Figure 3:
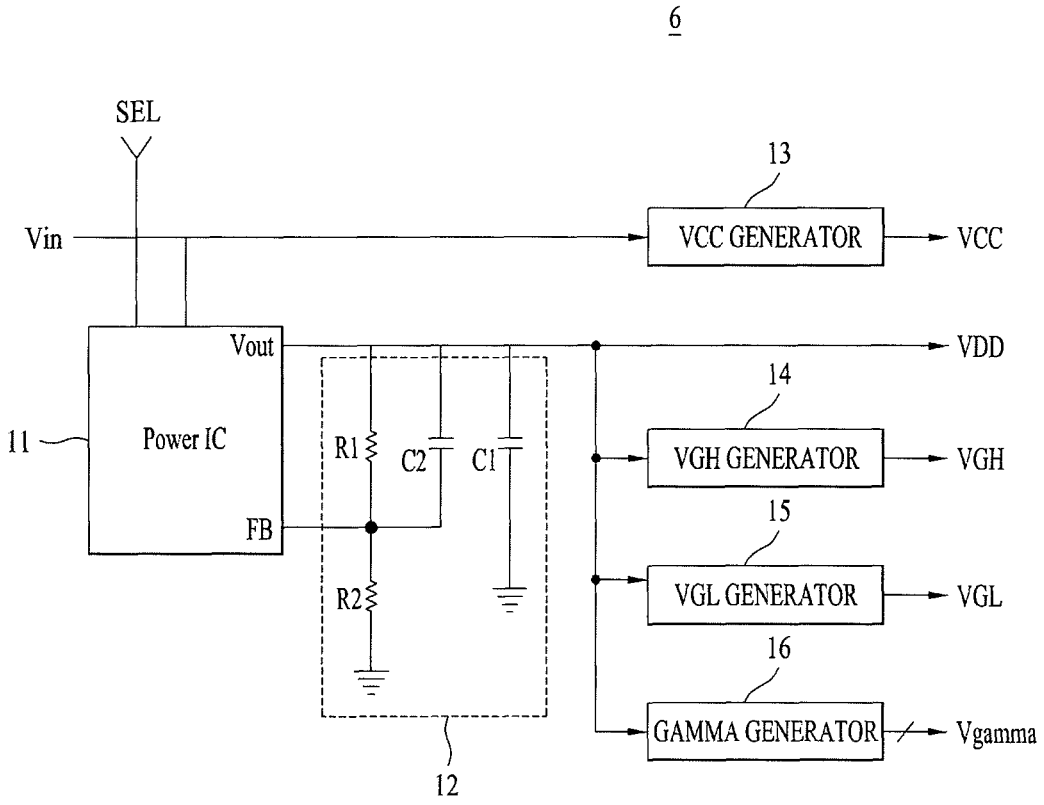
FIG. 3 is a block circuit diagram illustrating a detailed configuration of a drive voltage generating unit shown in FIG. 1.

FIG. 3 is a block circuit diagram illustrating a detailed configuration of the drive voltage generating unit shown in FIG. 1.

The drive voltage generating unit 6 shown in FIG. 3 includes a power IC 11 for varying the level of the feedback voltage thereof such that the level of the feedback voltage corresponds to the feedback reference voltage select signal SEL, thereby adjusting a feedback voltage charging period in accordance with the varied level of the feedback voltage, to generate drive voltages VDD having different levels respectively corresponding to the user image display mode and idle mode within the same period of time. The drive voltage generating unit 6 also includes a feedback circuit 12 arranged between a drive voltage output terminal Vout of the power IC 11 and a feedback terminal FB of the power IC 11, to charge feedback voltages of different levels respectively corresponding to the user image display mode and idle mode in accordance with feedback voltage charging periods respectively adjusted in accordance with the user image display mode and idle mode.

The drive voltage generating unit 6, which is configured as described above, may further include a supply voltage generator (VCC generator) 13 for lowering the level of an input voltage Vin, to generate a supply voltage VCC in the form of a constant voltage, a gate-high voltage generator (VGH generator) 14 for varying a reference drive voltage VDD having a level varied in accordance with a mode such that the reference drive voltage VDD has a level corresponding to a gate-high voltage VGH for driving the gate lines, and a gate-low voltage generator (VGL generator) 15 for varying the reference drive voltage VDD, which has a level varied in accordance with a mode, such that the reference drive voltage VDD has a level corresponding to a gate-low voltage VGL for driving the gate lines. The drive voltage generating unit 6 may also include a gamma voltage generator (gamma generator) 16 for dividing the reference drive voltage VDD, which has a level varied in accordance with a mode, into a plurality of gamma voltage levels, to generate a plurality of gamma voltages Vgamma having different levels.

The power IC 11 varies the level of the input voltage Vin to a predetermined constant voltage level, for example, a constant voltage level of 12V, to generate and output the reference drive voltage VDD, which has a positive level. In this instance, the power IC 11 raises or lowers the level of the drive voltage VDD such that the drive voltage VDD has a level inversely proportional to the level of the feedback voltage. To this end, the power IC 11 varies the level of the feedback voltage thereof such that the level of the feedback voltage corresponds to the level of the feedback reference voltage select signal SEL, using a multiplexer. In accordance with the varied level of the feedback voltage, the power IC 11 adjusts the feedback voltage charging period, using an operational amplifier and a switching element connected to an output terminal of the operational amplifier. Accordingly, the power IC 11 generates and outputs drive voltages VDD having different levels respectively corresponding to the user image display mode and the idle mode within the same period of time.

The feedback circuit 12 is arranged between the drive voltage output terminal Vout of the power IC 11 and the feedback terminal FB of the power IC 11, to charge the feedback voltage to different levels respectively corresponding to the user image display mode and idle mode in accordance with feedback voltage charging periods respectively adjusted in accordance with the user image display mode and idle mode. To this end, the feedback circuit 12 includes a first resistor R1 arranged between the drive voltage output terminal Vout of the power IC 11 and the feedback terminal FB of the power IC 11, a capacitor C2 arranged between the drive voltage output terminal Vout and the feedback terminal FB in parallel with the first resistor R1, and a second resistor R2 arranged between the feedback terminal FB and a low-level voltage source.

The supply voltage generator 13 lowers the level of the input voltage Vin, to generate and output a supply voltage VCC in the form of a constant voltage. The supply voltage VCC may have a correct voltage level, for example, a level of 3.3V. The supply voltage VCC generated as described above is supplied to the drive circuits for driving the display panel.

The gate-high voltage generator 14 varies the level of the drive voltage VDD output from the power IC 11 to a positive gate-high voltage level for driving the gate lines of the image display panel, in more detail, the level of the gate-high voltage VGH for turning on the switching elements of the image display panel via the gate lines.

The gate-low voltage generator 15 receives the supply voltage VCC as a low-level voltage while receiving the drive voltage VDD as a high-level voltage. The gate-low voltage generator 15 then generates and outputs the gate-low voltage VGL for driving the gate lines of the display panel at a low voltage level.

The gamma voltage generator 16 includes a voltage dividing circuit including a plurality of resistors connected in series and in parallel. Through the voltage dividing circuit constituted by the resistors, the gamma voltage generator 16 divides the drive voltage VDD into a plurality of gamma voltage levels, and thus generates and outputs a plurality of gamma voltages Vgamma having different levels.

Figure 4:
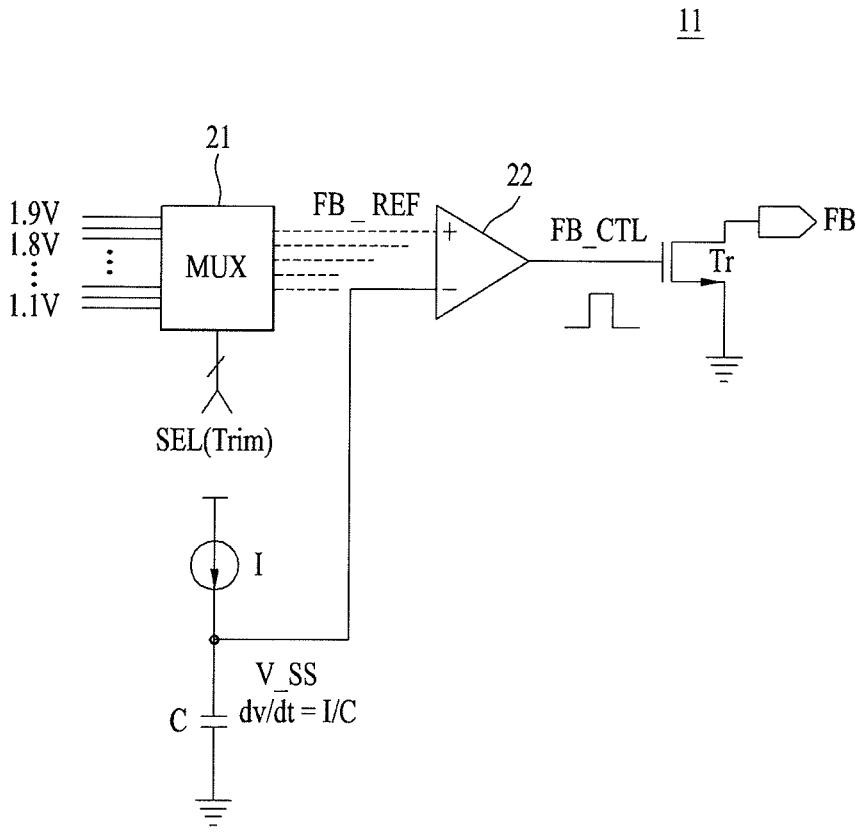
FIG. 4 is a circuit diagram illustrating a detailed configuration of a power IC shown in FIG. 3.

FIG. 4 is a circuit diagram illustrating a detailed configuration of the power IC shown in FIG. 3.

The power IC 11 of FIG. 4 includes a multiplexer 21 for receiving a plurality of voltages having different levels, and selecting and outputting one of the different voltages in accordance with the feedback reference voltage select signal SEL, to set the level of a feedback voltage FB_REF and to output the set feedback voltage FB_REF. The power IC 11 also includes an operational amplifier 22 for receiving the feedback voltage FB_REF and a start timing control signal V_SS, which has a gradually-increasing level, at inverting and non-inverting terminals thereof, respectively, to output a feedback voltage charging control signal FB_CTL during a period in which the start timing control signal V_SS has a lower level than the feedback voltage FB_REF. The power IC further includes a feedback switching element Tr for charging the feedback circuit 12 with a feedback voltage for a feedback voltage charging period in accordance with the feedback voltage charging control signal FB_CTL.

The multiplexer 21 receives a plurality of voltages having different levels ranging from a low level to a high level. The multiplexer 21 then selects and outputs one of the received different voltages in accordance with the feedback reference voltage select signal SEL, which is received from outside or from the timing controller 5. Thus, the multiplexer 21 sets the level of the feedback voltage FB_REF, and outputs the set feedback voltage FB_REF. Here, the level of the feedback voltage FB_REF is substantially a reference voltage level for determining a voltage charging period. That is, when the feedback voltage FB_REF is set to have a higher level, the feedback voltage charging period through the switching element Tr may increase. On the other hand, when the feedback voltage FB_REF is set to have a lower level, the feedback voltage charging period through the switching element Tr may decrease. Thus, the level of the feedback voltage FB_REF is substantially a reference voltage level for determining a voltage charging period.

Information as to an output start time for the drive voltage VDD in each of the image display mode and idle mode, for example, a soft start time of each mode, is stored using a trim area of an internal memory in the power IC 11. Preferably, different soft start times are set in accordance with the feedback reference voltage select signal SEL, the size of the display panel, the RC time constant of the power IC 11, and the level of the drive voltage VDD. In this regard, the feedback reference voltage select signal SEL may be set, based on various experimental values.

The operational amplifier 22 receives the feedback voltage FB_REF at the inverting terminal thereof, and receives the start timing control signal V_SS, which has a gradually-increasing level, at the non-inverting terminal thereof. The operational amplifier 22 then outputs a feedback voltage charging control signal FB_CTL to turn on the feedback switching element Tr, during a period in which the start timing control signal V_SS has a level lower than or equal to the feedback voltage FB_REF. On the other hand, during a period in which the start timing control signal V_SS has a higher level than the feedback voltage FB_REF, the operational amplifier 22 outputs the feedback voltage charging control signal FB_CTL to turn off the feedback switching element Tr.

Hereinafter, the principle of adjusting the soft start time of each mode will be described with reference to FIGS. 5 and 6.

Figure 5:
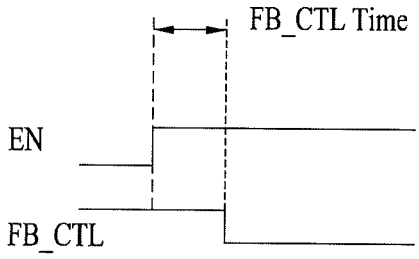
FIG. 5 is a waveform diagram depicting an output period of a feedback voltage charging control signal in FIG. 4.

FIG. 5 is a waveform diagram depicting an output period of the feedback voltage charging control signal in FIG. 4. FIG. 6 is a waveform diagram illustrating a method for generating the feedback voltage charging control signal in accordance with the feedback voltage and start timing control signal in FIG. 4.

The feedback switching element Tr enables a fast charging operation of the feedback terminal in accordance with the feedback voltage charging control signal FB_CTL. The time when the fast charging operation starts may be set to correspond to the time when the image display period for a previous frame expires, as shown in FIG. 5.

Figure 6:
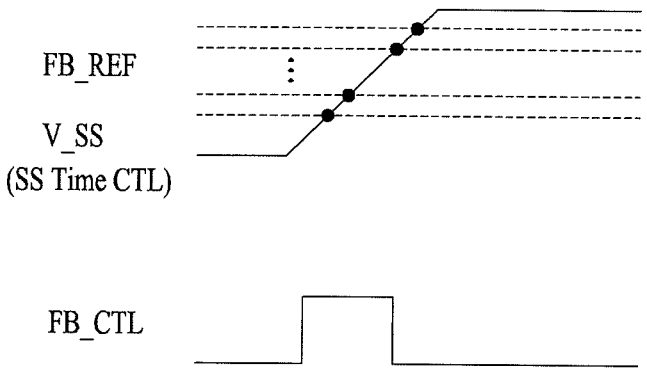
FIG. 6 is a waveform diagram illustrating a method for generating the feedback voltage charging control signal in accordance with a feedback voltage and a start timing control signal in FIG. 4.

As shown in FIG. 6, the start timing control signal V_SS is a voltage, which is supplied to the non-inverting terminal of the operational amplifier 22 while having a gradually-increasing level. The feedback voltage FB_REF is a reference voltage for adjusting the feedback voltage charging period. When the gradually-increasing level of the start timing control signal V_SS is lower than or equal to the level of the feedback voltage FB_REF, a feedback voltage charging control signal FB_CTL having a level to turn on the feedback switching element Tr is output. On the other hand, during a period in which the gradually-increasing level of the start timing control signal V_SS is higher than the level of the feedback voltage FB_REF, the operational amplifier 22 outputs a feedback voltage charging control signal FB_CTL having a level to turn off the feedback switching element Tr. Accordingly, the feedback voltage charging period is determined by the level of the feedback voltage FB_REF. Thus, the soft start time of each mode can be adjusted by the level of the feedback voltage FB_REF.

Figure 7:
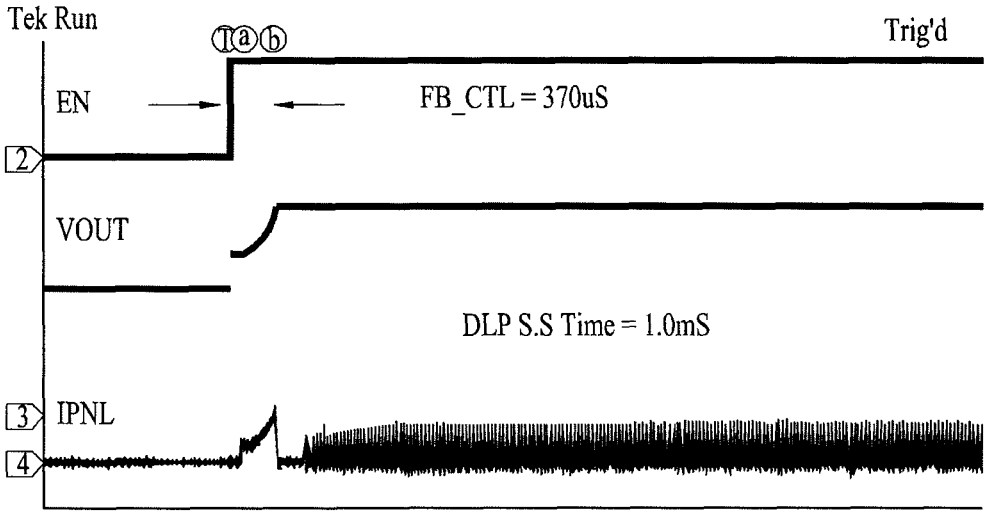
FIG. 7 is a waveform diagram depicting effects of reducing a charging period in each mode in accordance with a reduction in feedback voltage charging period.
Figure 8:
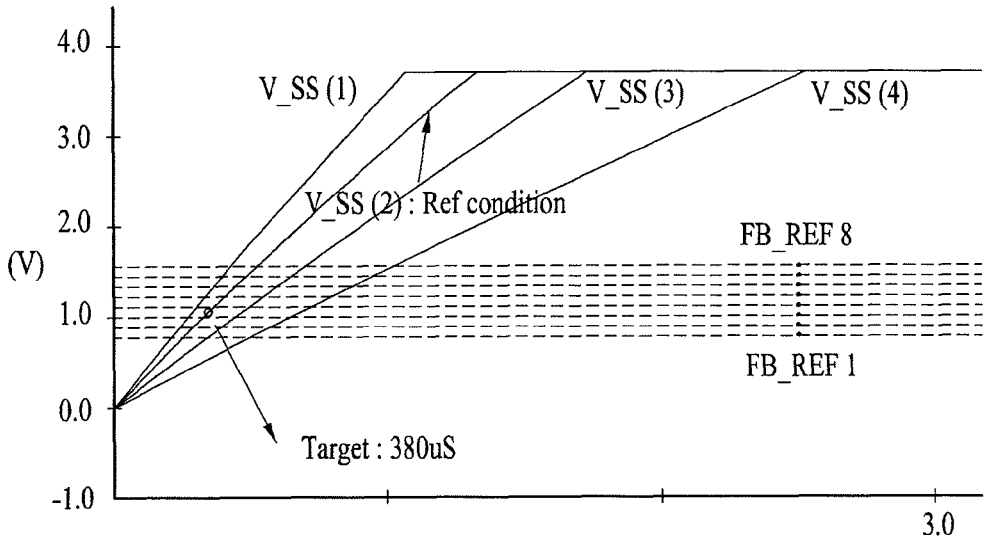
FIG. 8 is a graph for explaining a method for adjusting a soft start time of each mode, taking into consideration a tolerance of the power IC in FIG. 4.

FIG. 7 is a waveform diagram depicting effects of reducing the charging period in each mode in accordance with a reduction in feedback voltage charging period. FIG. 8 is a graph for explaining a method for adjusting the soft start time of each mode, taking into consideration a tolerance of the power IC in FIG. 4.

Referring to FIG. 7, upon mode change to the user image display mode or to the idle mode, the soft start time of each mode is adjusted to be 1.0 ms or less, for use thereof. Meanwhile, referring to FIG. 8, the power IC 11 according to the invention performs control and correction of the soft start time of each mode, taking into consideration the tolerance thereof. As described above, the level of the start timing control signal V_SS increases linearly. However, the current source, capacitance or the like in the power IC 11 exhibits a gradient different from those of other power ICs, due to the tolerance thereof. As a result, there may be a deviation among power ICs in terms of the soft start time of each mode. In order to enable adjustment of the soft start time, taking into consideration the tolerance of the power IC, in accordance with the invention, the multiplexer 21 is arranged upstream of the generator, which generates the start timing control signal V_SS, for fine adjustment.

As described above, the invention enables fast charging by adjusting the soft start time of the idle mode or image display mode to be within 2.0 ms, in spite of a drawback that the capacity of the capacitor at a feedback stage should be increased for stabilization of an output voltage. Also, it is possible to achieve a manual time adjustment through an internal circuit configuration. In addition, through a design capable of providing a function of adjusting and correcting deviations among ICs, the deviation among elements can be minimized and, as such, stable yield in mass production is assured.

As apparent from the above description, the organic light emitting diode display device and the driving method thereof according to the features of the invention can avoid display failure caused by flicker or glare occurring when the operation mode of the organic light emitting diode display device is changed to an idle mode under the condition that the organic light emitting diode display device is applied to a mobile communication device such as a smartphone or tablet computer, thereby achieving an enhancement in reliability.

It will be apparent to those skilled in the art that various modifications and variations can be made in the invention without departing from the spirit or scope of the inventions. Thus, it is intended that the invention covers the modifications and variations of this invention provided they come within the scope of the appended claims and their equivalents.

What is claimed is:

1. An organic light emitting diode display device comprising:

a display panel comprising a plurality of pixel regions;

a power supply unit configured to supply drive voltages having different levels respectively corresponding to a user image display mode and an idle mode to power lines of the display panel in accordance with the user image display mode and the idle mode, respectively;

a timing controller configured to control the power supply unit, to thereby control image display operations in accordance with the user image display mode and the idle mode, respectively; and a drive voltage generating unit configured to vary a level of a feedback voltage thereof in accordance with a predetermined feedback reference voltage select signal supplied from outside or from the timing controller so that a same period of time is taken to generate drive voltages upon a mode change to the user image display mode and a mode change to the idle mode, respectively, and then to output the drive voltages to the power supply unit wherein the drive voltage generating unit comprises:

a power IC that varies the level of the feedback voltage thereof such that the level of the feedback voltage corresponds to the predetermined feedback reference voltage select signal, thereby adjusting a feedback voltage charging period in accordance with the level of the feedback voltage, wherein the power IC is configured to generate the drive voltages having different levels respectively corresponding to the user image display mode and the idle mode within the same period of time; and a feedback circuit arranged between a drive voltage output terminal of the power IC and a feedback terminal of the power IC, to charge feedback voltages of different levels respectively corresponding to the user image display mode and the idle mode in accordance with feedback voltage charging periods respectively adjusted in accordance with the user image display mode and the idle mode, and wherein the power IC comprises:

a multiplexer configured to receive a plurality of voltages having different levels, and select and output one of the plurality of voltages in accordance with the predetermined feedback reference voltage select signal, wherein the multiplexer sets the level of the feedback voltage, and the multiplexer is configured to output the level of the feedback voltage;

an operational amplifier configured to receive the level of the feedback voltage and a start timing control signal, which has a gradually-increasing level, at inverting and non-inverting terminals thereof, respectively, to output a feedback voltage charging control signal during a period in which the start timing control signal has a lower level than the level of the feedback voltage; and a feedback switching element configured to charge the feedback circuit with a selected one of the feedback voltages for a selected one of the feedback voltage charging periods in accordance with the feedback voltage charging control signal.

2. The organic light emitting diode display device according to claim 1, wherein, the operational amplifier outputs the feedback voltage charging control signal to turn on the feedback switching element, during a period in which the gradually-increasing level of the start timing control signal is lower than or equal to the level of the feedback voltage, and the operational amplifier outputs the feedback voltage charging control signal, to turn off the feedback switching element, during a period in which the gradually-increasing level of the start timing control signal is higher than the level of the feedback voltage.

3. The organic light emitting diode display device according to claim 2, wherein the feedback reference control select signal sets the level of the feedback voltage of the multiplexer such that a soft start time of the user image display mode and a soft start time of the idle mode are adjusted to be within 2.0 ms upon mode change to the user image display mode and mode change to the idle mode, respectively.

4. A method for driving an organic light emitting diode display device, the method comprising:

supplying drive voltages having different levels respectively corresponding to a user image display mode and an idle mode to power lines of a display panel including a plurality of pixel regions, using a power supply unit, in accordance with the user image display mode and the idle mode, respectively;

controlling the power supply unit, to thereby control image display operations in accordance with the user image display mode and the idle mode, respectively;

varying a level of a feedback voltage in accordance with a predetermined feedback reference voltage select signal supplied from outside or from a timing controller so that a same period of time is taken to generate drive voltages upon a mode change to the user image display mode and a mode change to the idle mode, respectively; and outputting the drive voltages to the power supply unit;

wherein generating of drive voltages having different levels respectively corresponding to the user image display mode and the idle mode comprises:

varying the level of the feedback voltage such that the level of the feedback voltage corresponds to the predetermined feedback reference voltage select signal by a power IC, thereby adjusting a feedback voltage charging period in accordance with the level of the feedback voltage by varying, to generate the drive voltages having different levels respectively corresponding to the user image display mode and the idle mode within the same period of time; and charging feedback voltages of different levels respectively corresponding to the user image display mode and the idle mode in accordance with feedback voltage charging periods respectively adjusted in accordance with the user image display mode and the idle mode, by a feedback circuit arranged between a drive voltage output terminal of the power IC and a feedback terminal of the power IC, and wherein the generating of drive voltages having different levels respectively corresponding to the user image display mode and the idle mode comprises:

receiving a plurality of voltages having different levels by a multiplexer, and selecting and outputting one of the plurality of voltages by the multiplexer in accordance with the predetermined feedback reference voltage select signal, to set the level of the feedback voltage and to output the level of the feedback voltage;

receiving the level of the feedback voltage and a start timing control signal, which has a gradually-increasing level, at inverting and non-inverting terminals of an operational amplifier, respectively, to output a feedback voltage charging control signal during a period in which the start timing control signal has a lower level than the level of the feedback voltage; and charging the feedback circuit with a selected one of the feedback voltages for a selected one of the feedback voltage charging periods in accordance with the feedback voltage charging control signal by a feedback switching element.

5. The method according to claim 4, wherein the outputting of a feedback voltage charging control signal comprises:

outputting a feedback voltage charging control signal to turn on the feedback switching element, during a period in which the gradually-increasing level of the start timing control signal is lower than or equal to the level of the feedback voltage; and outputting the feedback voltage charging control signal, to turn off the feedback switching element, during a period in which the gradually-increasing level of the start timing control signal is higher than the level of the feedback voltage.

6. The method according to claim 5, wherein the feedback reference control select signal sets the level of the feedback voltage of the multiplexer such that a soft start time of the user image display mode and a soft start time of the idle mode are adjusted to be within 2.0 ms upon mode change to the user image display mode and mode change to the idle mode, respectively.

7. An Apparatus comprising:

a display panel;

a controller controlling a mode change between a display mode and an idle mode;

a driving voltage supplying unit supplying a driving voltage, having a different level voltage according to each mode, to the display panel, wherein the display panel displays an image according to each mode, without changing a driving start timing during the mode change;

a power IC varying a level of a feedback voltage which corresponds to a feedback reference voltage select signal inputted from the controller, adjusting a feedback voltage charging period in accordance with the level of the feedback voltage and generating the drive voltage having different levels respectively during the mode change; and a feedback circuit arranged between a drive voltage output terminal of the power IC and a feedback terminal of the power IC, charging the feedback voltage of different levels respectively according to the feedback voltage charging period, wherein the power IC comprises:

a multiplexer configured to receive a plurality of voltages having different levels, and select and output one of the plurality of voltages in accordance with the feedback reference voltage select signal, wherein the multiplexer sets the level of the feedback voltage, and the multiplexer is configured to output the level of the feedback voltage;

an operational amplifier configured to receive the level of the feedback voltage and a start timing control signal, which has a gradually-increasing level, at inverting and non-inverting terminals thereof, respectively, to output a feedback voltage charging control signal during a period in which the start timing control signal has a lower level than the level of the feedback voltage; and a feedback switching element configured to charge the feedback circuit with a selected one of the feedback voltages for a selected one of the feedback voltage charging periods in accordance with the feedback voltage charging control signal.

8. The apparatus according to claim 7, wherein the drive voltage is in inverse proportion to the level of the feedback voltage.

9. The apparatus according to claim 7, wherein the driving start timing of each mode is adjusted by the level of the feedback voltage.

* * * * *